US006499867B1

(12) United States Patent
Neal

(10) Patent No.: US 6,499,867 B1
(45) Date of Patent: Dec. 31, 2002

(54) BOAT RUNNING LIGHT FIXTURE

(76) Inventor: Ross M. Neal, 1354 Herman Dupuis Rd., Breaux Bridge, LA (US) 70517

( * ) Notice: Subject to any disclaimer, the term of this patent is extended or adjusted under 35 U.S.C. 154(b) by 12 days.

(21) Appl. No.: 09/759,193

(22) Filed: Jan. 10, 2001

(51) Int. Cl.[7] ..... B63B 45/00

(52) U.S. Cl. ..... 362/477; 362/523; 362/287; 362/396; 362/427

(58) Field of Search ..... 362/477, 523, 362/543, 190, 231, 269, 285, 396, 427, 540, 542, 287

(56) References Cited

U.S. PATENT DOCUMENTS 4,884,173 A * 11/1989 Cassidy ..... 362/477
5,508,895 A * 4/1996 Wagoner, Jr. ..... 362/477
5,537,299 A * 7/1996 Perry ..... 362/477
5,566,384 A * 10/1996 Chien ..... 362/542
5,711,591 A * 1/1998 Jordan ..... 362/477
6,174,078 B1 * 1/2001 Ohm et al. ..... 362/477
2001/0024369 A1 * 9/2001 Kitchin ..... 362/477

* cited by examiner

*Primary Examiner*—Sandra O'Shea
*Assistant Examiner*—Peggy A Neils
(74) *Attorney, Agent, or Firm*—Joseph N. Breaux

(57) ABSTRACT

An improved running light fixture that includes a user aimable flood light attached to the convention running like support shaft and plug. The flood light is provided with strobe mechanism for providing a strobe effect that may be used by the boater to attract the attention of other boaters who could then come to provide assistance.

1 Claim, 4 Drawing Sheets

BOAT RUNNING LIGHT FIXTURE

TECHNICAL FIELD

The present invention relates to removable boat running light fixtures that include a plug-in power supply and light support stem that has a bottom plug portion that is plugged into the electrical power running light socket provided at the front of a boat and a RED/GREEN running light fixture mechanically mounted in connection with a top end of the plug-in power supply and light support stem and in electrical connection with the bottom plug portion of the plug-in power supply and light support stem such that electrical power is delivered to the lights within the RED/GREEN light fixture from the electrical power running light socket provided at the front of a boat when the bottom plug portion is plugged into the electrical power running light socket of the boat; the improvement includes providing a high intensity driving flood/strobe light assembly in mechanical connection with the RED/GREEN running light fixture and providing a multi-directional pivot joint between the top end of the plug-in power supply and light support stem and the combination RED/GREEN running light and the high intensity driving flood/strobe light assembly such that a user can aim a light beam emitted from the high intensity driving flood/strobe light assembly in a desired direction prior to driving the boat during dim or dark ambient light conditions; the high intensity driving flood/strobe light assembly being supplied with power from the bottom plug portion of the plug-in power supply and light support stem and including a three position switch, a flood lamp assembly and a strobe control circuit including a strobe lamp power output, a power input and a variable output strobe intensity control mechanism; the switch power input of the three-position switch being wired in connection with the bottom plug portion of the plug-in power supply and light support stem such that when the three-position switch is in an "off" position, an open circuit exists between the switch power input and both the flood lamp assembly and the power input of the strobe control circuit; when the three-position switch is in a "flood lamp on" position, a closed circuit exists between the switch power input and the flood lamp assembly causing it to continuously illuminate and an open circuit exists between the switch power input and the power input of the strobe control circuit; and when the three-position switch is in a "strobe lamp on" position, an open circuit exists between the switch power input and the flood lamp assembly and a closed circuit exists between the switch power input and the power input of the strobe control circuit causing the strobe control circuit to cause the strobe lamp power output to intermittently apply strobe power to the flood lamp assembly at a rate determined by the position of the variable output strobe intensity control mechanism.

BACKGROUND ART

It is often difficult for the driver/pilot of a boat to pilot/driver the boat in dim or dark conditions, especially when the boat must be driven/piloted in shallow, narrow canals and/or bayous such as those that exist all over the lower portion of South Louisiana. Although the boat driver/pilot could hold a spot light with one hand to find the banks and other hazards as the boat moves through the water in the darkness, this practice is dangerous as the boat driver/pilot needs one hand to steer the boat while using the other hand to simultaneously control the speed and forward/reverse direction of the boat motor. Attempting to steer and control the boat motor with one hand while handling a spot light with the other hand can result in serious injuries to the boat driver/pilot and also any occupants of the boat should the driver/pilot run into a submerged log, a sandbar, or under low overhanging tree limbs. It would be a benefit, therefore, to have a high intensity flood light that could be mechanically attached to the very front of the boat. Because the floodlight is attached to the very front of the boat and aimed in an initial desired direction by the boat driver/pilot, the driver/pilot is able easily aim the beam form the floodlight in the required direction by steering the front of the boat slightly in the direction to be illuminate while still having the ability to rapidly reverse the engine, slow down, and/or steer around a hazard. Because boats vary, the user must be able to aim the floodlight for viewing from his particular driving/piloting location, it would be desirable if the floodlight was attached to a support with a multi-direction pivot mechanism to allow the beam of the headlight to be properly aimed. In addition, because the floodlight would not be needed during daylight hours, it would be a further benefit if the flood light could be connected to the running light assembly of the boat that is adapted to seat into a power socket provided at the front of the boat. In addition, because a boater may require assistance from another boat at some time during dark conditions, it would be still further benefit if the flood light included a strobe mechanism for providing a strobe effect to attract the attention of other boaters who could then come to investigate.

GENERAL SUMMARY DISCUSSION OF INVENTION

It is thus an object of the invention to provide an improved boat running light fixture for removable boat running light fixtures that include a plug-in power supply and light support stem that has a bottom plug portion that is plugged into the electrical power running light socket provided at the front of a boat and a RED/GREEN running light fixture mechanically mounted in connection with a top end of the plug-in power supply and light support stem and in electrical connection with the bottom plug portion of the plug-in power supply and light support stem such that electrical power is delivered to the lights within the RED/GREEN light fixture from the electrical power running light socket provided at the front of a boat when the bottom plug portion is plugged into the electrical power running light socket of the boat; the improvement includes providing a high intensity driving flood/strobe light assembly in mechanical connection with the RED/GREEN running light fixture and providing a multi-directional pivot joint between the top end of the plug-in power supply and light support stem and the combination RED/GREEN running light and the high intensity driving flood/strobe light assembly such that a user can aim a light beam emitted from the high intensity driving flood/strobe light assembly in a desired direction prior to driving the boat during dim or dark ambient light conditions; the high intensity driving flood/strobe light assembly being supplied with power from the bottom plug portion of the plug-in power supply and light support stem and including a three position switch, a flood lamp assembly and a strobe control circuit including a strobe lamp power output, a power input and a variable output strobe intensity control mechanism; the switch power input of the three-position switch being wired in connection with the bottom plug portion of the plug-in power supply and light support stem such that when the three-position switch is in an "off" position, an open circuit exists between the switch power input and both the flood lamp assembly and the power input of the strobe control circuit; when the three-position switch is in a "flood lamp on" position, a closed circuit exists between the switch power input and the flood lamp assembly causing it to continuously illuminate and an open circuit exists between the switch power input and the power input of the strobe control circuit; and when the three-position switch is in a "strobe lamp on" position, an open circuit exists between the switch power input and the flood lamp assembly and a closed circuit exists between the switch power input and the power input of the strobe control circuit causing the strobe control circuit to cause the strobe lamp power output to intermittently apply strobe power to the flood lamp assembly at a rate determined by the position of the variable output strobe intensity control mechanism.

Accordingly, an improved boat running light fixture is provided for running light fixtures that include a plug-in power supply and light support stem that has a bottom plug portion that is plugged into the electrical power running light socket provided at the front of a boat and a RED/GREEN running light fixture mechanically mounted in connection with a top end of the plug-in power supply and light support stem and in electrical connection with the bottom plug portion of the plug-in power supply and light support stem such that electrical power is delivered to the lights within the RED/GREEN light fixture from the electrical power running light socket provided at the front of a boat when the bottom plug portion is plugged into the electrical power running light socket of the boat; the improvement includes providing a high intensity driving flood/strobe light assembly in mechanical connection with the RED/GREEN running light fixture and providing a multi-directional pivot joint between the top end of the plug-in power supply and light support stem and the combination RED/GREEN running light and the high intensity driving flood/strobe light assembly such that a user can aim a light beam emitted from the high intensity driving flood/strobe light assembly in a desired direction prior to driving the boat during dim or dark ambient light conditions; the high intensity driving flood/strobe light assembly being supplied with power from the bottom plug portion of the plug-in power supply and light support stem and including a three position switch, a flood lamp assembly and a strobe control circuit including a strobe lamp power output, a power input and a variable output strobe intensity control mechanism; the switch power input of the three-position switch being wired in connection with the bottom plug portion of the plug-in power supply and light support stem such that when the three-position switch is in an "off" position, an open circuit exists between the switch power input and both the flood lamp assembly and the power input of the strobe control circuit; when the three-position switch is in a "flood lamp on" position, a closed circuit exists between the switch power input and the flood lamp assembly causing it to continuously illuminate and an open circuit exists between the switch power input and the power input of the strobe control circuit; and when the three-position switch is in a "strobe lamp on" position, an open circuit exists between the switch power input and the flood lamp assembly and a closed circuit exists between the switch power input and the power input of the strobe control circuit causing the strobe control circuit to cause the strobe lamp power output to intermittently apply strobe power to the flood lamp assembly at a rate determined by the position of the variable output strobe intensity control mechanism is provided.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
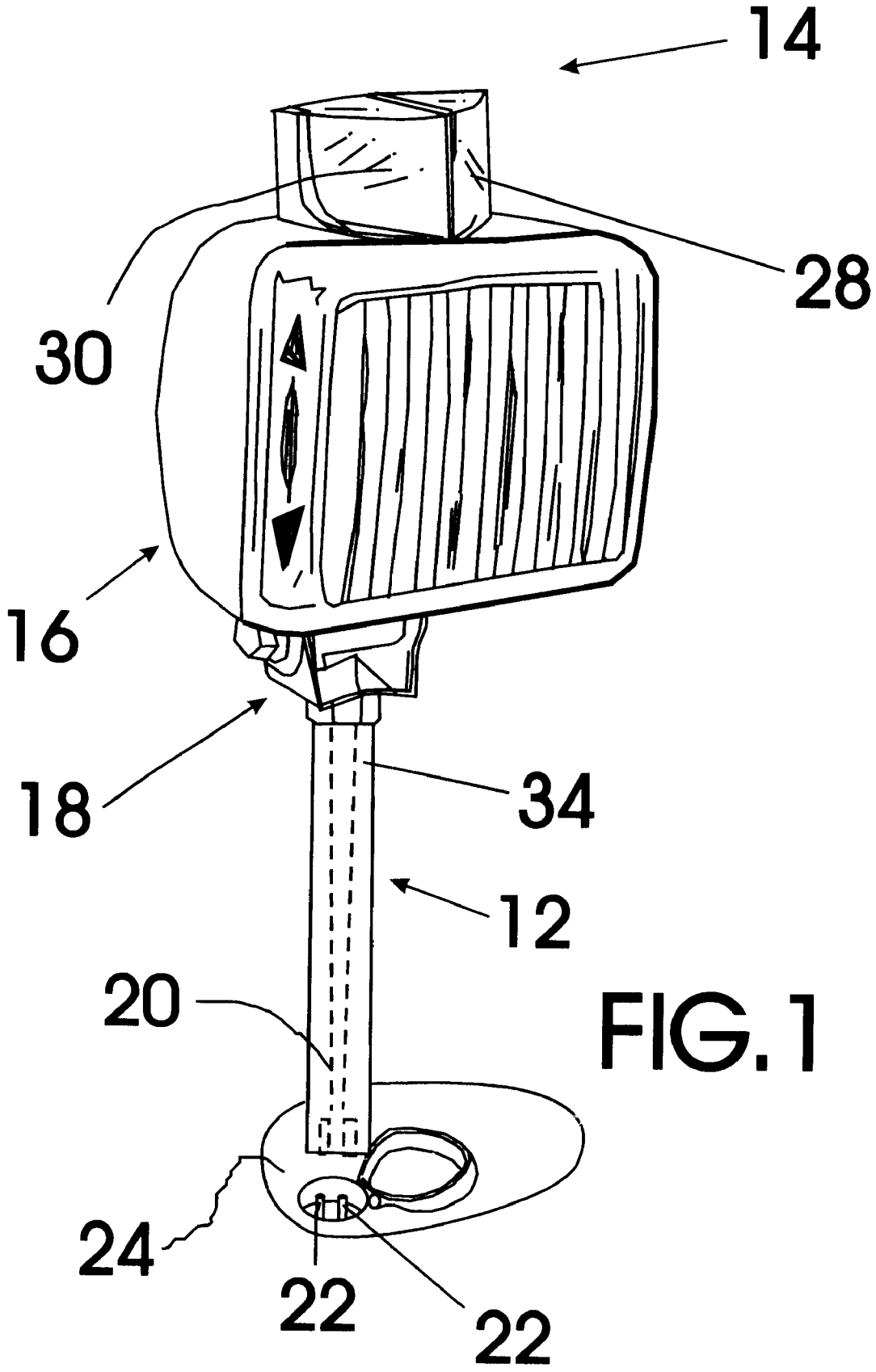
FIG. 1 is a perspective view of a representative running light with the improvement of the present invention incorporated therein.
Figure 3:
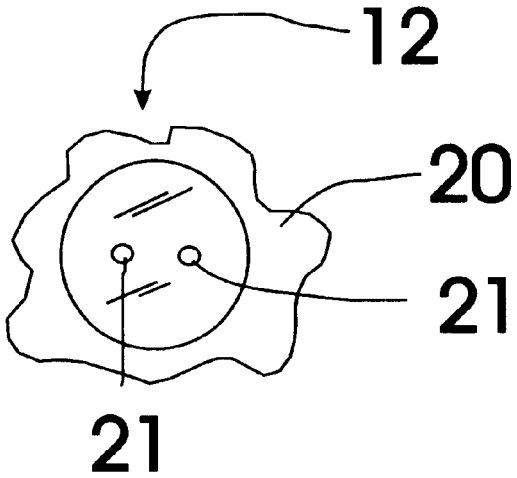
FIG. 3 is a plan view of the bottom plug portion of the plug-in power supply and light support stem showing the two sockets for receiving the two upwardly projecting electrical contact prongs positioned within the electrical power running light socket provided at the front of a boat.
Figure 2:
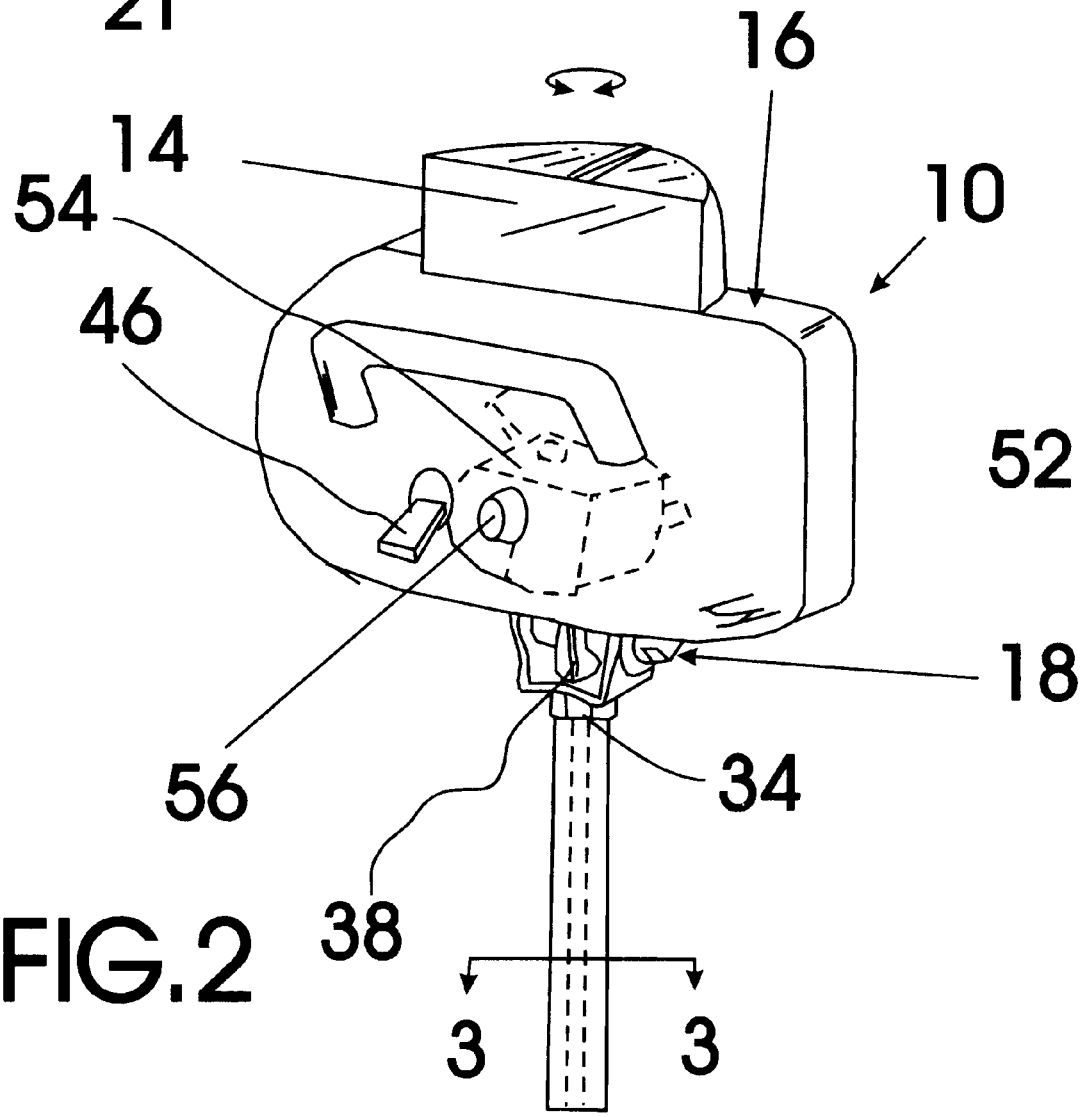
FIG. 2 is a perspective view of the backside of the running light of FIG. 1.
Figure 4:
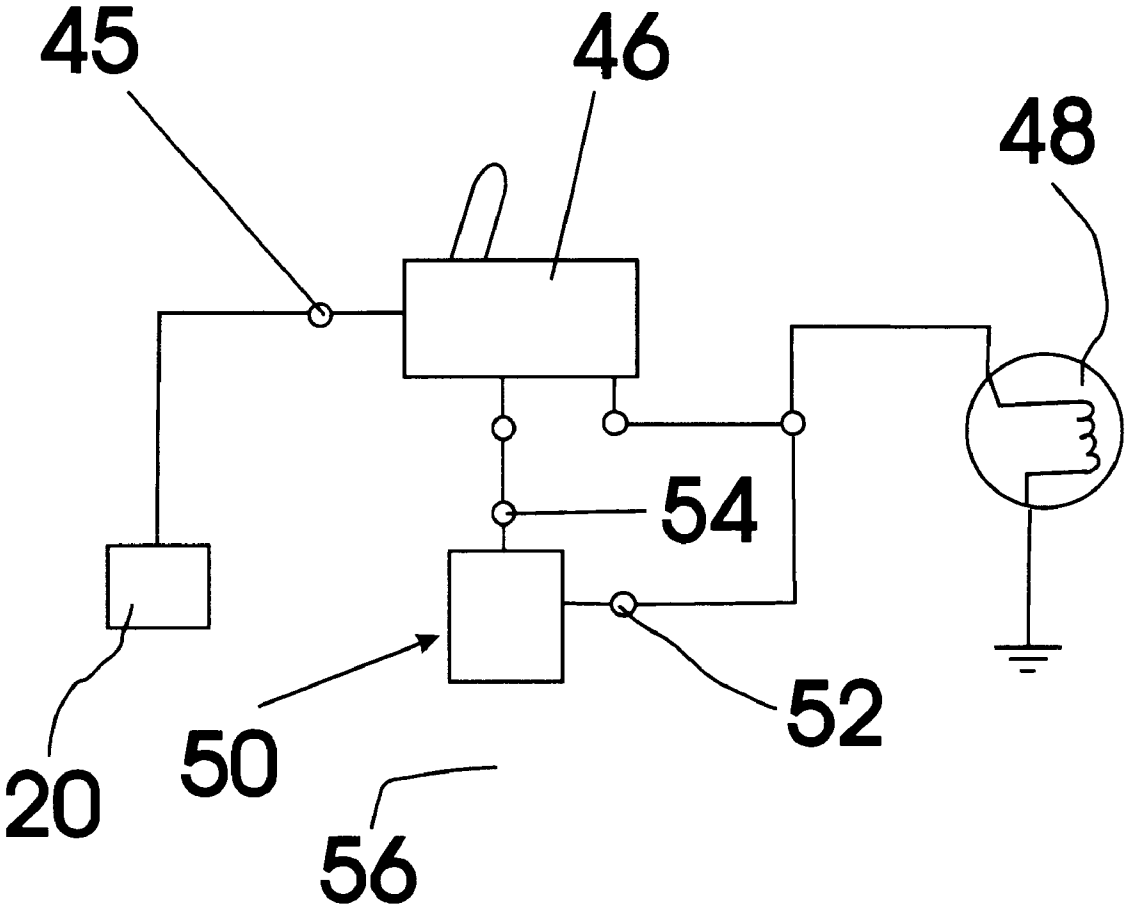
FIG. 4 is a schematic diagram showing the interconnections between the boat power supply, the three position switch, the flood lamp assembly and the strobe control circuit.

FIGS. 1–4 show various aspects of a first exemplary embodiment of the improved boat running light fixture of the present invention generally designated 10. Improved boat running light fixture 10 includes a plug-in power supply and light support stem, generally designated 12; a RED/GREEN running light fixture, generally designated 14; a high intensity driving flood/strobe light assembly, generally designated 16; and a multi-directional pivot joint, generally designated 18.

Plug-in power supply and light support stem 12 has a bottom plug portion, generally designated 20, has two sockets 21, are sized to receive therein the two upwardly projecting electrical contact prongs 23 positioned within an electrical power running light socket 22 provided at the front of a boat 24. The exterior of bottom plug portion 20 is sized to friction fit into electrical power running light socket 22 and hold plug-in power supply and light support stem 12 in a substantially upright position. RED/GREEN running light fixture 14 has one or more convention electrical light bulbs housed behind a red tinted housing glass section 28 and a green tinted housing glass section 30 so that one half of RED/GREEN running light fixture 14 emits red light and the other side emits green light. This color scheme indicates to an approaching boat what direction the another boat is coming from in the dark.

High intensity driving flood/strobe light assembly 16 has RED/GREEN running light fixture 14 rigidly affixed to the top thereof and is attached to a top end 34 of plug-in power supply and light support stem 12 with multi-directional pivot joint 18. Electrical wires 38 are run through from the two sockets 21 of bottom plug portion 20 of plug-in power supply and light support stem 12 out through top end 34 into high intensity driving flood/strobe light assembly 16 and then into RED/GREEN running light fixture 14. RED/GREEN running light fixture 14 becomes illuminated simply by inserting bottom plug portion 20 into electrical power running light socket 22 of the boat.

High intensity driving flood/strobe light assembly 16 includes a three position switch 46 having a power input 45 in connection with the boat power supply through bottom plug portion 20, a flood lamp assembly 48 and a strobe control circuit, generally designated 50, including a strobe lamp power output 52, a power input 54 and a variable output strobe intensity control mechanism 56. When the three-position switch 46 is in an "off" position, an open circuit exists between the switch power input 45 and both the flood lamp assembly 48 and the power input 54 of strobe control circuit 50. When the three-position switch 46 is in a "flood lamp on" position, a closed circuit exists between switch power input 45 and flood lamp assembly 48 causing flood lamp assembly 48 to continuously illuminate and an open circuit exists between switch power input 45 and power input 54 of strobe control circuit 50. When three-position switch 46 is in a "strobe lamp on" position, an open circuit exists between switch power input 45 and flood lamp assembly 48 and a closed circuit exists between switch power input 45 and power input of the strobe control circuit 54 causing strobe control circuit 50 to cause strobe lamp power output 52 to intermittently apply strobe power to flood lamp assembly 48 at a rate determined by the position of the variable output strobe intensity control mechanism 56.

Figure 5:
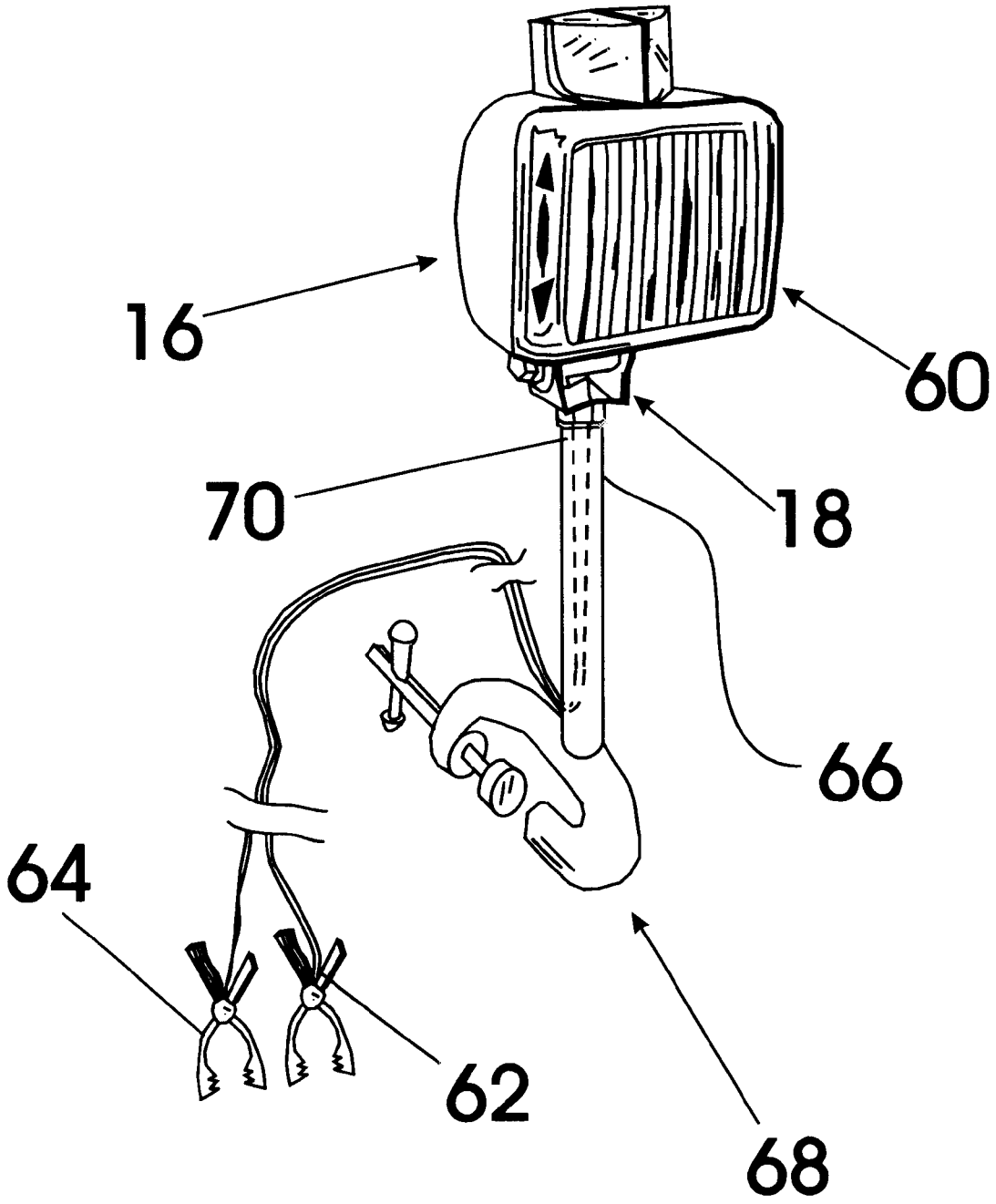
FIG. 5 is a perspective view of a second exemplary embodiment of the boat running light fixture of the present invention.

FIG. 5 shows various aspects of a second exemplary embodiment of the boat running light fixture of the present invention generally designated 60. Running light fixture 60 includes spring loaded, power supply connecting clips 62,64 that are each connectable to one terminal of a marine battery and a support post 66 with a stem support C-clamp, generally designated 68. Support post 66 has a top end 70 pivotally attached to a high intensity driving flood/strobe light assembly, generally designated 16 as previously described, with a multi-directional pivot joint, generally designated 18 as previously described.

It can be seen from the preceding description that an improved boat running light fixture has been provided.

It is noted that the embodiment of the boat running light fixture described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A boat running light fixture comprising:

a high intensity driving flood/strobe light assembly;

a support post with a stem support C-clamp;

a multi-directional pivot joint; and two spring loaded, power supply connecting clips that are each connectable to one terminal of a marine battery and in electrical connection with the high intensity driving flood/strobe light assembly;

the support post being pivotally attached at a top end thereof to the high intensity driving flood/strobe light assembly with the multi-directional pivot joint;

the high intensity driving flood/strobe light assembly being supplied with power through the two spring loaded, power supply connecting clips and including a three position switch, a flood lamp assembly and a strobe control circuit including a strobe lamp power output, a power input and a variable output strobe intensity control mechanism;

the three-position switch including a switch power input wired in connection with the two spring loaded, power supply connecting clips such that:

when the three-position switch is in an "off" position, an open circuit exists between the switch power input and both the flood lamp assembly and the power input of the strobe control circuit;

when the three-position switch is in a "flood lamp on" position, a closed circuit exists between the switch power input and the flood lamp assembly causing it to continuously illuminate and an open circuit exists between the switch power input and the power input of the strobe control circuit; and when the three-position switch is in a "strobe lamp on" position, an open circuit exists between the switch power input and the flood lamp assembly and a closed circuit exists between the switch power input and the power input of the strobe control circuit causing the strobe control circuit to cause the strobe lamp power output to intermittently apply strobe power to the flood lamp assembly at a rate determined by the position of the variable output strobe intensity control mechanism.

* * * * *